United States Patent [19]

Mazzarantani

[11] Patent Number: 4,986,046

[45] Date of Patent: Jan. 22, 1991

[54] METHOD AND APPARATUS FOR INSTALLING A CURTAIN WALL

[76] Inventor: Renato E. Mazzarantani, 7933 NW. 71st St., Miami, Fla. 33166

[21] Appl. No.: 426,889

[22] Filed: Oct. 25, 1989

[51] Int. Cl.[5] ..... E04H 1/00; E04H 3/00

[52] U.S. Cl. ..... 52/235; 52/768

[58] Field of Search ..... 52/235, 506, 768, 769

[56] References Cited

U.S. PATENT DOCUMENTS

| | | | |
|---|---|---|---|
| 3,488,906 | 1/1970 | Brooks | 52/235 |
| 3,888,055 | 6/1975 | Gallo | 52/235 |
| 4,519,173 | 5/1985 | Roberts | 52/235 |
| 4,565,040 | 1/1986 | Kaminaga | 52/235 |
| 4,571,905 | 2/1986 | Kaminaga | 52/506 X |
| 4,614,069 | 9/1986 | Tanikawa . | |
| 4,619,090 | 10/1986 | McManys . | |
| 4,650,702 | 3/1987 | Whitmyer . | |
| 4,662,135 | 5/1987 | Tanikawa . | |
| 4,662,136 | 5/1987 | Tanikawa . | |
| 4,662,145 | 5/1987 | Tanikawa . | |
| 4,782,636 | 11/1988 | Stoakes . | |
| 4,817,352 | 4/1989 | DeLange | 52/235 |
| 4,866,896 | 9/1989 | Shreiner . | |
| 4,873,805 | 10/1989 | Ting . | |
| 4,873,806 | 10/1989 | Jeschke . | |

*Primary Examiner*—Richard E. Chilcot, Jr.
*Assistant Examiner*—Deborah McGann Ripley
*Attorney, Agent, or Firm*—Malin, Haley, McHale, DiMaggio & Crosby

[57] ABSTRACT

A method and apparatus for installing the outer members of a curtain wall comprising a plurality of spring-loaded tab members connected to curtain wall panel members and swingable into or out of supporting connection with corresponding stop members, said stop members being fixedly connected at predetermined positions to the vertical side rails of the curtain wall frame members. The tab members transmit the gravity load and wind load of the panel members to the curtain wall frame members through said support members.

The individual curtain wall sections are positioned in the vertical guide members of the curtain wall frame at any convenient location (e.g.: ground level) and raised therein to a mounting position. The respective tab members rotate around the stop members as the curtain wall section is raised but are biased outwardly to prevent said curtain wall sections from being lowered, as by the force of gravity. The invention allows a safe and simplified means of lifting, positioning and mounting curtain wall outer members.

5 Claims, 3 Drawing Sheets

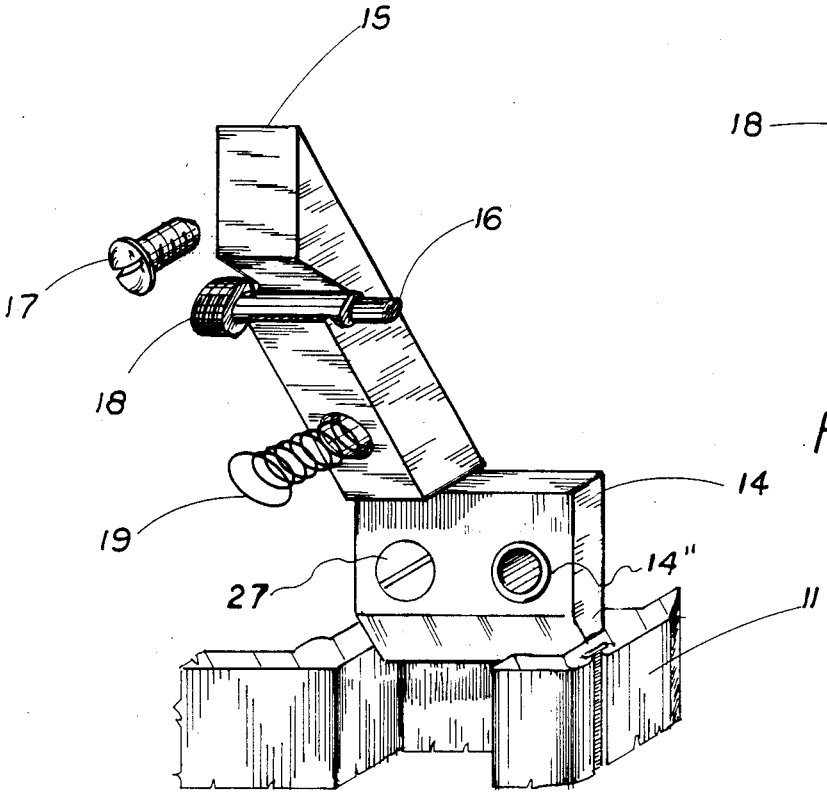
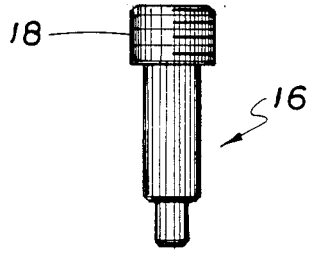
FIG. 5
FIG. 3
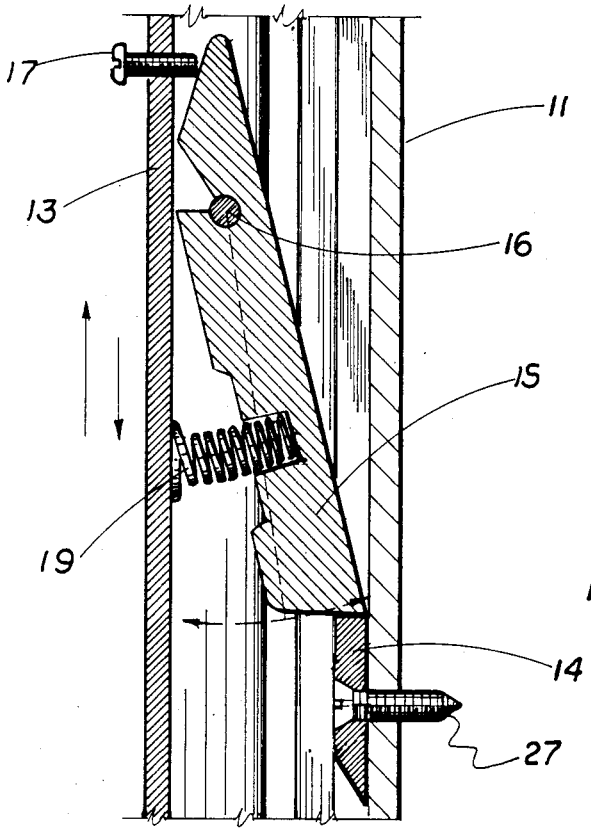
FIG. 4

METHOD AND APPARATUS FOR INSTALLING A CURTAIN WALL

BACKGROUD OF THE INVENTION (1) Field of the Invention

The present invention relates to a method and apparatus for safely and conveniently lifting sections of a building outer wall to form a curtain wall of a building.

(2) Description of the Prior Art

It has, in recent times, become very popular to cover the exterior of building structures, particularly office-type buildings, with glass or other planar panels. These coverings have become known as curtain walls.

Processes for mounting a curtain wall unit, in which a building body is framed with steel frame members to which are attached curtain wall members, is known in the art. The individual curtain wall sections are transported to a mounting position on the building by lifting with a crane or hoist installed on the roof or on the ground, and then the curtain wall unit is mounted to the building body.

According to this mounting process, since a curtain wall member, section or unit is simply lifted up with a crane, transporting the curtain wall unit up to a mounting position was dangerous and the operation of mounting the curtain wall unit to a building body was also difficult and dangerous because, among other things, the curtain wall unit was free to swing on the supporting crane cable. Under strong wind conditions, the curtain wall unit is free to swing, and eventually it may be turned over or may collide with a previously mounted curtain wall unit or the building frame and be damaged or destroyed.

In addition, as disclosed in Japanese Laid-Open Patent Specification No. 55-132861, another mounting process has been known, in which a pair of guide wires are disposed along an outer wall surface of a buiIding in parallel to each other and nearly in the vertical direction, and facing plate is transported up to a mounting position by lifting it along the guide wires and is mounted to the outer wall surface of the building. This structure does not allow for lifting the sections safely within the framework of the building facia.

Imai, U.S. Pat. No. 4,591,308, discloses another method of lifting and mounting an outer wall member of a curtain wall. This method involves a cumbersome jig which is separate from the curtain wall frame and requires additional steps of mounting the outer wall member once it has been lifted into position.

All of the processes heretofore disclosed require the transporting of each successive curtain wall section to be separate and apart from the building itself, resulting in an undesireably dangerous condition.

SUMMARY OF THE INVENTION

The present invention discloses a novel apparatus and method for safely, rapidly and efficiently constructing a curtain wall facade on a building body. The apparatus is comprised of a window mullion constructed and arranged so as to form a vertical, parallel trackway on either side of the window opening adapted to guide curtain wall sections along the face of the building and within the mullion framework while said sections are being hoisted into their respective mounting positions by hoisting cables or other like means for positioning.

To facilitate a safe and convenient mounting of curtain wall sections, there is provided a spring-biased one-way latch means for releasably supporting curtain wall sections, the latch means itself being connected to the movable curtain wall section frame and rotatable about a mounting/hinge pin. Corresponding support member means are mounted along the guide rails or mullions of the building in positions which allow the latch means to be supported thereon when any said curtain section is no longer supported by its hoisting means. This permits a curtain wall member to be firmly supported against gravity and wind load at various positions during the hoisting operation and also at its proper mounting position. The novel use of this locking mechanism provides a safe and simple permanent curtain wall mounting system for an outer panel member of a curtain wall. The latch means permits the curtain wall sections to be raised but not lowered.

It is therefore a principal object of the present invention to provide a novel method and apparatus for the simplified installation of the outer panel members of a curtain wall.

A more specific object of the present invention is to provide a guide system for lifting and positioning an outer wall member of a curtain wall safely along rigid rails comprising or attached to the curtain wall or building frame.

In accordance with these and other objects which will be apparent hereinafter, the instant invention will now be described with particular reference to the accompanying drawings.

BRIEF DESCRIPTION OF THE DRAWINGS

In the accompanying drawings:

FIG. 3 is a perspective view of the tab member, hinge pin (16), spring (19) and support member (14) comprising the latch means.

FIG. 4 is a cross-sectional elevational view of the latch means attached to a curtain wall panel frame or guided member (13) and the accompanying support member (14) mounted to a guide/mullion (11) member, taken along the line 4—4 shown in FIG. 1.

FIG. 5 is a side view of the supporting hinge pin (16).

DESCRIPTION OF THE PREFERRED EMBODIMENT

Figure 1:
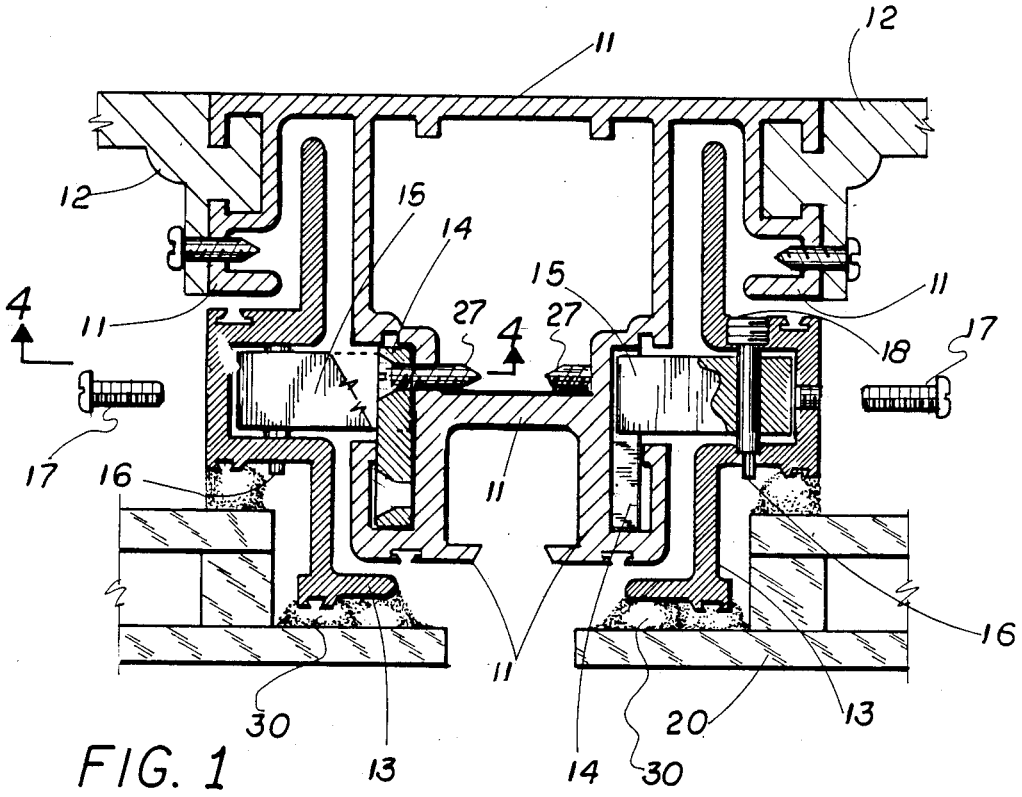
FIG. 1 is a top plan particular cutaway view of a section of the guide rail mullion (11) and curtain wall panel frame (13) showing portions of a pair of guided curtain wall sections (20), including the novel latch means.
Figure 2:
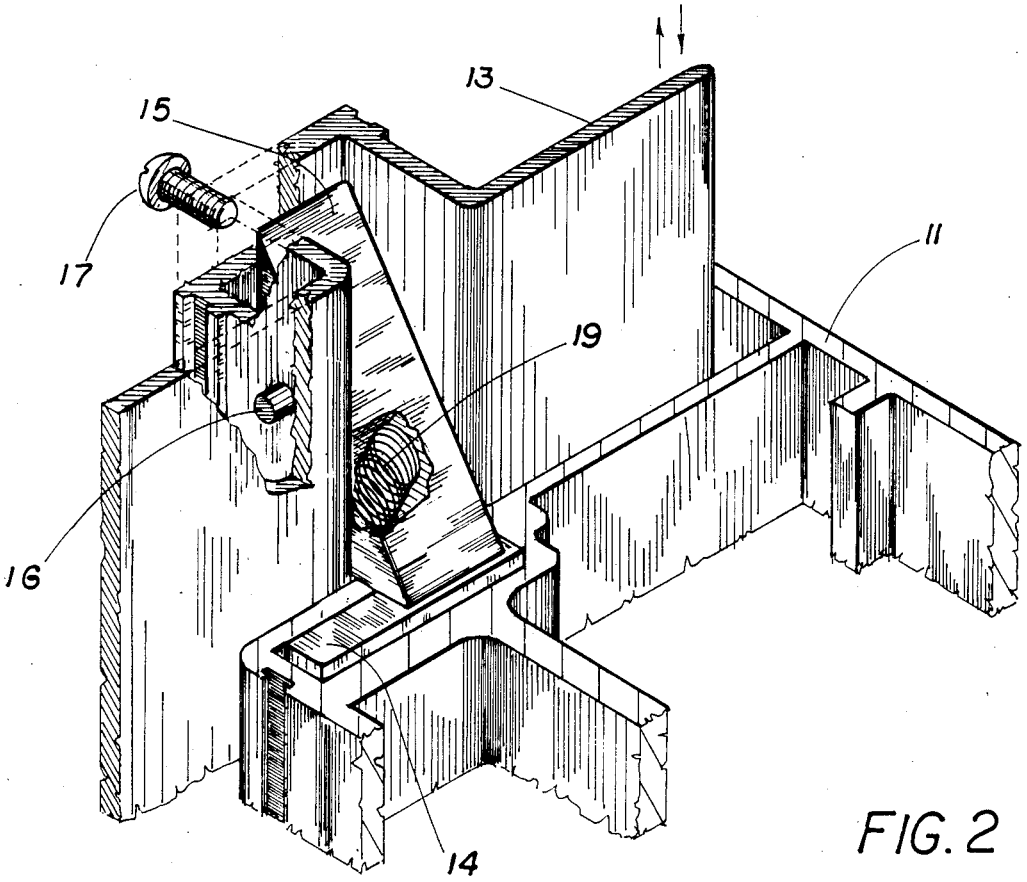
FIG. 2 is a partial cutaway perspective view of one side of a guide rail/mullion member (11) and the accompanying curtain wall panel frame (13), including the novel latch means.

Referring now to FIGS. 1–4, a generally vertical guide member 11, which is in the preferred embodiment a modified window mullion, is attached to the building (not shown) in its intended position by a suitable attachment means 12. The guide member 11 serves as a guiding frame member means for guiding the curtain wall section or panels 20 during installation and is part of the window mullion vertical side frame. Each curtain wall panel 20 is rigidly affixed by any appropriate expedient to curtain wall panel frame members 13, said frame members 13 being connected to said panels 20 in such a way as to be placed into alignment with vertical track ways defined by window mullions or guiding members 11. The guide member 11 may be extruded or manufactured by any convenient method and is shaped to mate slidably in interfitting engagement with a curtain wall panel frame or guided members 13 on at least one side. It should be noted that the guide member/mullion 11 should be continuous along the vertical length over which curtain wall panel sections 20 are to be slid so as to facilitate the smooth transportation of panel sections along the face of the building. The curtain wall panel frame members 13 are each connected to opposite vertical sides of panel sections 20 and correspond generally to the height of a panel section.

The curtain wall panel frame members 13 comprise at least a portion of the frame which generally surrounds each curtain wall section 20. Said curtain wall panel frame member 13 is affixed by suitable means to the outer panel member 20 of the curtain wall, which may be a planar sheet of glass or stone, for example. The panels 20 may be sealed during or after installation by any convenient means, such as silicone sealant shown by the number 30 in FIG. 1. A support member 14 FIGS. 1, 2, 3, 4 and 8 is mounted to the guide member/-mullion 11 in a suitable position and by suitable means and is adapted to operably coact with a latch means for preventing vertical downward movement of any curtain wall panel section 20 after installation thereof in the building. The latch means is preferably a tab member 15 hingedly connected to curtain wall panel frame member 13 by a hinge pin 16 which is secured across the curtain wall panel 13, preferably by threads 18 (FIG. 5).

Said guide member 11 and said guide member 13 make up a guide means for translating each curtain wall section 20 into its final resting position as part of the curtain wall of a building being constructed.

A removable connecting means such as screw 17 may be employed for urging any tab member 15 into the "open" or non-support position when it is desired to allow a curtain wall section 20 to be removed outwardly or move downwardly. Screw 17 is turned inwardly so as to rotate tab 15 clockwise if viewed in FIG. 4, thereby causing the lower end T of tab member 15 to move out of vertical registry with the upper band S of support member 14.

A biasing means such as spring 19 is located between the lever means 15 and the curtain wall panel member 13. Said spring 19 is located on the underside of the hinge pin and biases the lever means 15 into the "latched" or "closed" or load supporting position shown in FIG. 4 as desired.

Figure 8:
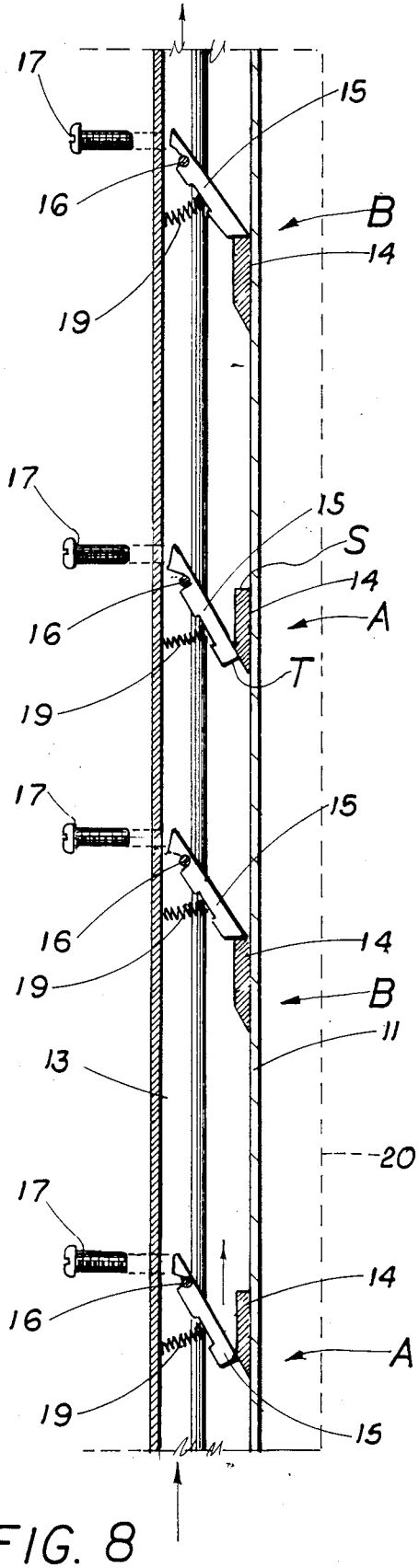
FIG. 8 is a cutaway view showing a latch means/support member arrangement.

The hinge pin and tab member assembly of FIGS. 4 and 8 is used as a load transfer means to support the various curtain wall sections in the building frame and is of a design to allow simple insertion and extraction, if necessary, and is installed by means of a threaded screw end 18 or some other suitable means. As can be appreciated from the foregoing, tab members 15 are permitted to "ride" over support members 14 and thereby rock about pin 16 between generally the position shown as A in FIG. 8 and the position shown as B therein as each successive curtain wall section 20 is raised within a building structure. Said tab members are urged into a closed position, that is, the position shown generally by the letter A, as each wall section 20 is raised, similar to an umbrella clip. As each tab member 15 passes over the top edge of a support member 14, the biasing means, in this case spring 19, urges said tab means into an "open" or load supporting position. In this "open" position, shown by the letter B in FIG. 8, the lower end T of tab member 15 engages the upper generally horizontal land surface S of support member 14, causing the weight of said wall section 20 to be transferred through pin 16, tab member 15, support member 14 and into curtain wall frame member 11, as shown in FIGS. 1, 2, 3, 4, and 8, and finally to the building superstructure.

Figure 6:
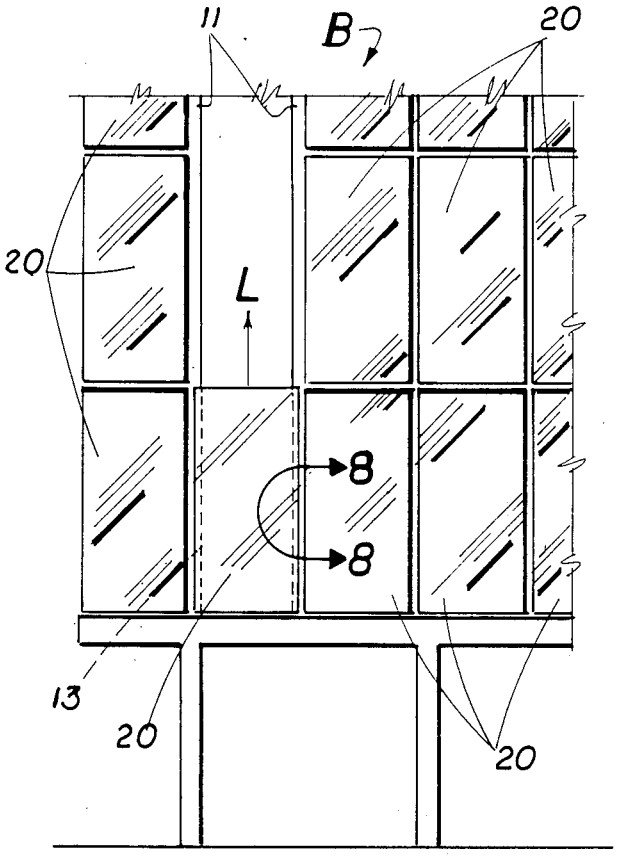
FIG. 6 is a front elevational view of a building being constructed using the method and apparatus of the instant invention.
Figure 7:
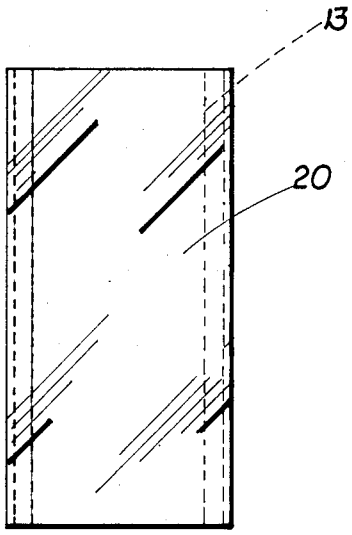
FIG. 7 is an elevational view of a curtain wall panel member.

Referring to FIGS. 6 and 7, it can be seen that curtain wall panel section 20 has connected thereto curtain wall panel frame members 13 which are configured to ride in interfitting engagement within corresponding structure of guide member/mullion 11. The support member 14 is mounted to the guide member 11. The support member 14 defines an indentation 14' with mounting holes 14'' into which a screw 27 or similar affixing means may be inserted. The lower portion of support member 14 converges downwardly generally to a point at its intersection with frame member 11 in order to ease movement of the tab member 15 along member 11 in an upwards direction during installation. The top of support member 14 defines a flat land S suitable for engaging the latch means 15 in load transferring relationship.

Referring now also to FIG. 8, each vertical side frame member 13 of a curtain wall panel member 20 includes a suitable number of attached, spring-loaded, rotatable latch means as previously disclosed herein. Said panel member 20 is positioned between two guiding members 11 with the vertical curtain wall panel frame members 13 engaging tracks ways within mullions 11. The panel member 20 is then raised by suitable means, such as a lifting load indicated by the letter L in FIG. 6, to its intended position. During the raising process, the spring means 19 of the latch mechanism is compressed due to movement of the tab member 15 upwards along the front sloping face of support member 14. As the tab member 15 passes the support member 14, the spring means 19 expands, rotating the latch member 15 about hinge pin 16 and into the "closed" or load bearing position. In this position, the weight of the panel member 20 is supported on said support members 14 through pad members 15, the load from which is distributed preferably evenly over the support members 14 used for that particular panel.

The staggered arrangement between "A" and "B" of the curtain wall panel support means may be replaced by a non-staggered arrangement, allowing all tab members 15 to contact the support members 14 simultaneously.

An outer wall member 20 may thus be raised and locked into its intended position in a series of vertical lifting steps or in one lifting motion with no further manipulation of the outer wall member necessary after it has been raised to the desired height. Upon release of the member 20 from the lifting load L, it will remain in place, held by the engagement of the latch members 15 with the respective support tabs 14.

Alternatively, additional and further securement apparatus and steps may be included in the installation process.

The instant invention has been shown and described herein in what it is considered to be the most practical and preferred embodiment. It is recognized, however, that departures may be made therefrom within the scope of the invention and that obvious modifications will occur to a person skilled in the art.

What is claimed is:

1. An apparatus for installing panel members of a curtain wall, comprising:

guide means, said guide means including a rail system having both guiding and guided members; and said guided members being integrally connected to said panel members, said guided members being slidably associated with said guiding members in parallel association;

latch means, said latch means being hingedly connected to said guided member; and support means for supporting the weight and wind load of a panel member, said support means being affixed to said guiding member and being disposed thereon to operatively engage corresponding latch means in load supporting relation.

2. The apparatus of claim 1, wherein:

said guiding member is affixed in a generally vertical manner as a frame member of said curtain wall.

3. The apparatus of claim 2, wherein:

said latch means comprises a lever rotatably connected to said guided member and being further associated with a biasing means connected between said latch means and said guided member.

4. The apparatus of claim 3, wherein said biasing means is a spring.

5. Apparatus for installing a curtain wall panel in a building under construction or an existing building, comprising:

a pair of vertical frame rail members each connected to vertical side edges of said panel;

curtain wall frame members connected to said building, sized and shaped to receive said rail members in mating, sliding relationship;

curtain wall panel support means operatively disposed between said frame rail members and said curtain wall frame members for supporting said curtain wall panel in said building against gravity and wind load, wherein said wall panels can be raised upwardly within said building frame yet are constrained against downward movement by said curtain wall panel support means;

wherein said curtain wall panel support means is comprised of:

a plurality of tab members hingedly connected to said frame rails at spaced positions, said tab members constructed and arranged to support the weight of said curtain wall panel;

a corresponding plurality of support members integrally connected to said curtain wall frame members, constructed and arranged to support the weight of said curtain wall panel through said tab members.

* * * * *